US010815672B1

(12) United States Patent
Dunne

(10) Patent No.: US 10,815,672 B1
(45) Date of Patent: Oct. 27, 2020

(54) TILE ATTACHMENT DEVICE AND SYSTEM

(71) Applicant: Julie Dunne, Buffalo Grove, IL (US)

(72) Inventor: Julie Dunne, Buffalo Grove, IL (US)

( * ) Notice: Subject to any disclaimer, the term of this patent is extended or adjusted under 35 U.S.C. 154(b) by 0 days.

(21) Appl. No.: 16/585,725

(22) Filed: Sep. 27, 2019

(51) Int. Cl.
*E04F 13/09* (2006.01)
*E04F 13/08* (2006.01)

(52) U.S. Cl.
CPC ..... *E04F 13/09* (2013.01); *E04F 13/0885* (2013.01)

(58) Field of Classification Search
CPC ..... E04F 13/09; E04F 13/0885
See application file for complete search history.

(56) References Cited

U.S. PATENT DOCUMENTS 4,513,941 A * 4/1985 Yamaguchi ..... E04F 13/0862 249/91
5,205,091 A 4/1993 Brown
5,592,787 A 1/1997 Ophardt
5,916,102 A 6/1999 Peyton
6,796,049 B1 9/2004 Claxon
7,178,300 B2 2/2007 Elsing
7,246,475 B2 7/2007 Bauer
7,814,721 B2 * 10/2010 Raineri ..... E04F 13/04 52/443
7,984,600 B2 7/2011 Alford
8,122,670 B2 2/2012 Matthee
8,156,705 B2 4/2012 Alford
8,096,093 B1 7/2012 Poon
8,539,727 B2 9/2013 Lui
8,590,252 B2 11/2013 Cordeiro
8,769,902 B2 7/2014 King
8,887,462 B2 * 11/2014 Tatari ..... E04F 13/09 52/384
9,845,604 B2 12/2017 Lockwood
9,963,890 B1 * 5/2018 Allen ..... E04G 1/153
10,106,989 B2 * 10/2018 Calmes ..... E04F 13/147
10,301,821 B2 5/2019 Gosling
2008/0271397 A1 * 11/2008 Raineri ..... E04F 13/0885 52/403.1
2014/0053487 A1 * 2/2014 Tatari ..... E04F 13/0803 52/386
2017/0356191 A1 * 12/2017 Calmes ..... E04F 13/147

* cited by examiner

*Primary Examiner* — Rodney Mintz

(57) ABSTRACT

The invention is a device and system for installing tiles without the use of adhesives or grout directly on a substrate.

6 Claims, 3 Drawing Sheets

TILE ATTACHMENT DEVICE AND SYSTEM

CROSS REFERENCE TO RELATED APPLICATIONS

Not applicable.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to a device and system for hanging blocks of tile on walls or other surfaces.

Background of the Invention

The use of wall tiles is well known, and the hanging or application of such tiles is known as a task favoring a certain amount of user skill and/or experience. Before placing tile on a wall or other substrate using standard methodology, a tile adhesive first must be applied over the wall itself, over the drywall, plaster or other surface. Typically, this adhesive is grooved with a notched trowel before the tile is overlaid and spacers applied while the adhesive dries. After drying, grout is applied and later sealed. As used herein, the term "substrate" shall refer to any surface material over which tile may be laid or applied.

The installation of tile over standard substrates such as drywall, cement board, rigid waterproof boards, masonry, etc., requires a list of twenty or more various materials and tools. To name a few, the installer needs a caulking gun, chalk line, grout, grout sealer, grout float, mortar, hammer, level, tape, trowel, pull bar, sander, tile cutter, tile spacers, sponge, square, silicone sealer, tile adhesive, tile edge and various other tiling tools.

As with wall tile installation, the removal of wall tile is similarly if not more difficult and time consuming. Attempting to remove tile without safety protection such as safety glasses, goggles, heavy gloves can be quite hazardous. The tiles are locked into place by the hardened adhesives, so removal from inside corners must usually start by beating out one or more tiles with a hammer. Further, tiles are impossible to remove without significantly damaging the substrate, such that a worker wishing to transition to a non-tiled surface must usually demolish and replace the substrate.

What is needed is a device and system to simply and quickly install and remove tile without the requirement to apply adhesive to the substrate, thereby preventing the need to demolish and replace such substrate.

BRIEF SUMMARY OF THE INVENTION

In a preferred embodiment, a tile installation device comprising a tile panel to which tiles may be adhered using a tile adhesive, two outer mounting strips to be located above and below such tile panel, wherein each outer mounting strip comprises a mounting surface that can be attached to an underlying surface and a panel holding edge to overlay an edge of the tile panel and hole such tile panel edge against the underlying surface.

In another preferred embodiment, the tile installation device as described herein, comprising two or more tile panels, with one outer mounting strip on the top edge of a top tile panel, and a second outer mounting strip on the bottom edge of the bottom tile panel, further comprising an inner mounting strip at the meeting point of each two tile panels, such inner mounting strip comprising a central mounting surface between two panel holding edges, each such panel holding edge overlaying a different tile panel.

In another preferred embodiment, the tile installation device as described herein, wherein the panel and each mounting strip are made of recycled plastic.

In another preferred embodiment, the tile installation device as described herein, wherein the panel and each mounting strip is made of polyethylene terephthalate, high density polyethylene or polyvinyl chloride.

In another preferred embodiment, the tile installation device as described herein, wherein the mounting strips are attached to the underlying substrate with screws.

In another preferred embodiment, a tile installation system using the tile hanging device as described herein, wherein one outer mounting strip is attached to a vertical substrate with a panel holding edge facing upward, a tile panel is placed against the underlying surface with the lower edge of the tile panel under such panel holding edge, a second outer mounting strip with its panel holding edge facing downward is then attached to the underlying surface with such downward-facing panel holding edge overlaying the top edge of the tile panel, tile adhesive is applied over the tile panel surface, tiles are placed into the adhesive and grout is applied between the tiles.

In another preferred embodiment, the tile installation system as described herein, wherein the tile panel is subsequently removed and replaced with a replacement panel and such replacement panel either ready for tiling or has already been tiled.

DETAILED DESCRIPTION OF THE INVENTION

Figure 1:
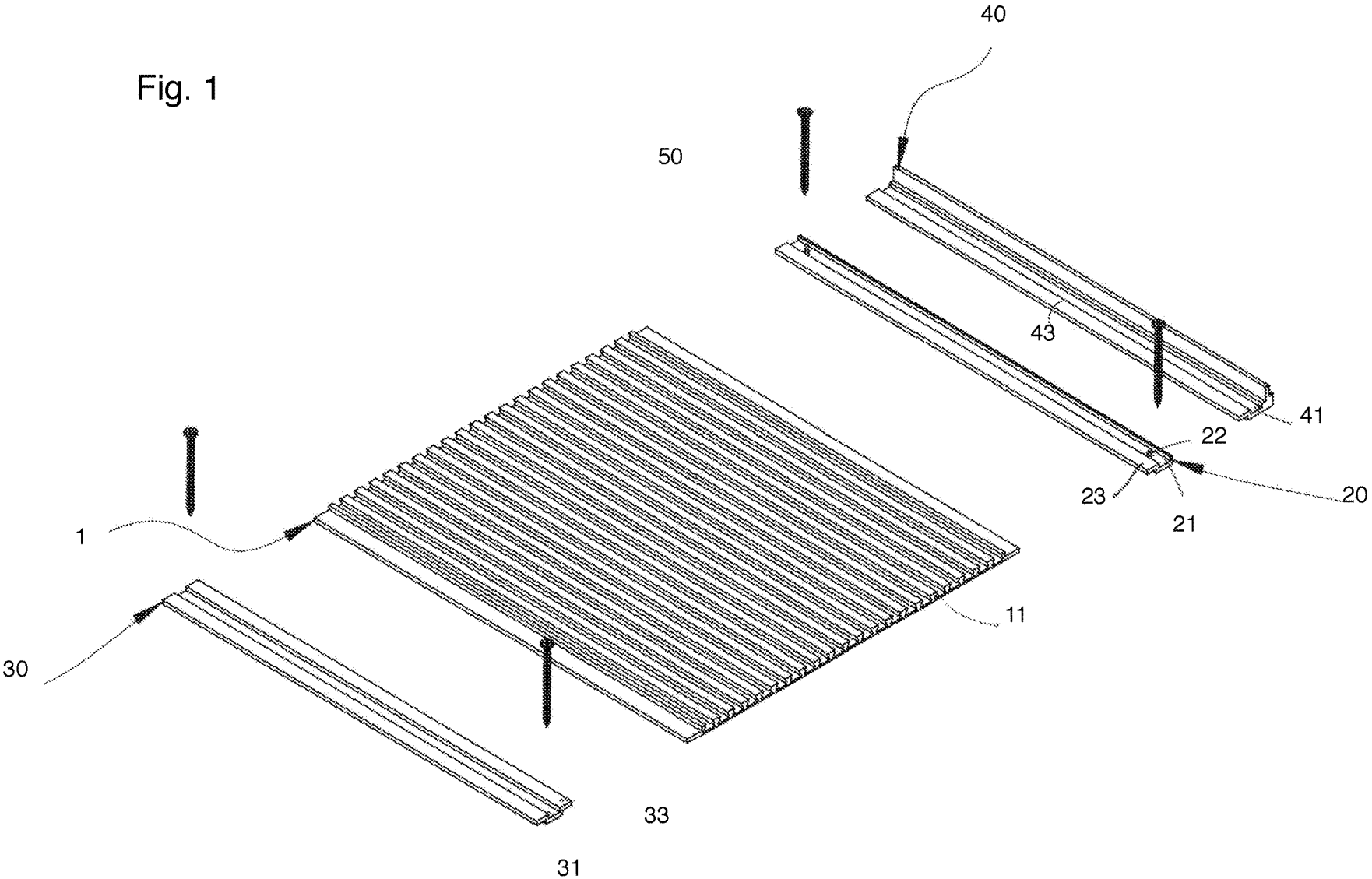
FIG. 1 is a line drawing evidencing an exploded view of the tile installation device.

We disclose a panel device for the installation of tiles without the use of glue, grout, spackle or other adhesive materials directly on the substrate. The panel device can be installed over any substrate, including but not limited to drywall, plaster, paneling or similar materials.

Each tile panel is designed to be fully held in place by mounting strips that are screwed into or otherwise attached to the substrate. All mounting strips are to be embodied as brackets with a mounting surface comprising a plurality of screw holes through which drywall or other screws appropriate to a given substrate may be drilled to secure the mounting strip to the substrate. Each mounting strip will further comprise one or two raised panel holding edges to overlay adjacent tile panel(s) and hold them fast to the substrate.

The tile panels themselves may consist of any shape or size needed for a given project. Although the typical shape required for many tiling jobs would be rectangular, the disclosed panel could also take any less conventional shape, for example circular, ovular or octagonal, either to match a given wall space or for decorative purposes. It can be cut using utility knives or saws, or other commercially known cutting tools.

In one embodiment, the tile panels will be designed with a plurality of parallel horizontal grooves to hold tile adhesive. In this embodiment, the tile is installed over the grooved panel using mortar, grout, and conventional materials and methods. This default tiling method will involve mounting of the panel onto the wall or other surface via mounting strips first, followed by application of adhesive, tile and grout over the panel. In an alternative method, mortar, tile and grout would be added to the panel first, with the fully assembled panel and tile being mounted second. The alternative method would allow for quick replacement of existing tile panels with pre-set replacements, allowing the user to quickly mix and match tile panels for different looks at different times.

The panels and mounting strips can be made of any suitably rigid material, including but not limited to plastics, metals or ceramics. In a preferred embodiment, such components are made of a recycled plastic-based material that does not bond to the mortar, allowing for re-use of all parts. Such plastics may contain, without limitation, polyethylene terephthalate (PET), high density polyethylene (HDPE), polyvinyl chloride (PVC), low-density polyethylene, polypropylene, polystyrene, or other, similar commercially available plastics. In the event that metal is used for either tile panels or mounting strips, aluminum or another similar lightweight metal or alloy is preferred.

In an alternative embodiment, the tile panel itself may comprise raised tile slots, with pairs of facing L-shaped slot pieces fitted to the proper tile height and depth such that the tiles are placed on the panel by sliding them adjacent to one another into such slots. The surface of the panel in contact with the tile would be smooth to allow for sliding. Such design may optionally include caps at the end of each tile line to prevent separation, without any use of grout or mortar.

The primary advantages of the disclosed device and tiling system over existing methodology is that, once hung, large blocks of tile may be quickly removed and replaced without the laborious work of removing tile from a wall covered in adhesive. Further, unlike conventional tile removal, the disclosed device and system allows for tile removal wherein the tile can remain intact and available for re-use either in another location or the same location at another time.

DETAILED DESCRIPTION OF THE FIGURES

FIG. 1 is an exploded view showing the entire tile hanging device 1. Corner mounting strip 40 is attached to a substrate (not pictured) at its mounting surface 41 with drywall screws 42, while its holding edge 43 angles towards outer mounting strip 20, where such holding edge 43 will overlay the mounting surface 21, which will itself also be attached to the substrate with drywall screws. The panel overlay edge 23 of outer mounting strip 30 is angled towards tile panel 10 and will overlay the corresponding edge 13 of such panel. Panel 10 evidences panel grooves 11 ready for the application of a tile adhesive. On the opposite side of the panel is located inner mounting strip 30, whose mounting surface 31 will also be attached to the substrate with screws, while one of its panel overlay edges 33 angles towards the corresponding edge 13 of panel 10. Also pictured is corner mounting strip 40.

Figure 2:
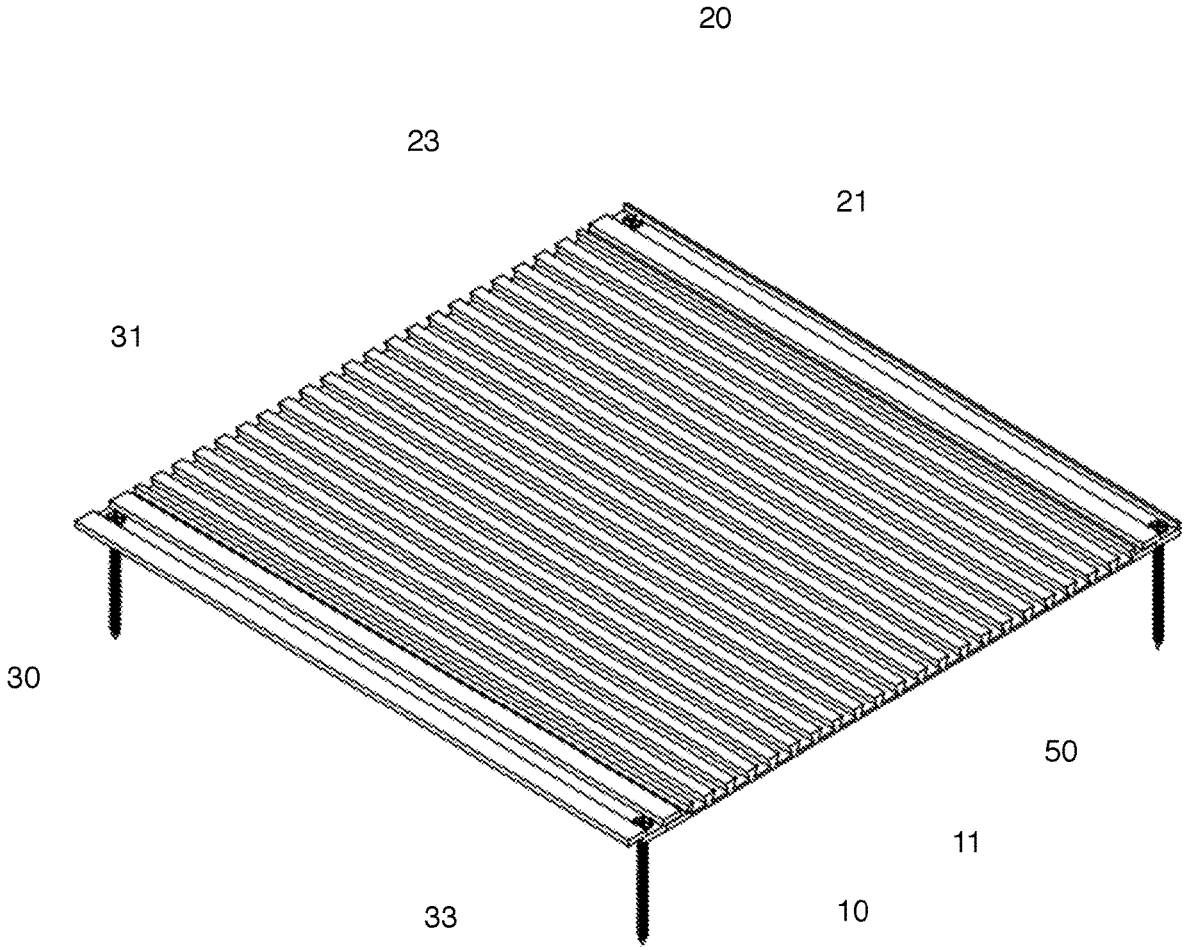
FIG. 2 is a line drawing evidencing a fully assembled tile installation device.

FIG. 2 is a drawing of a fully mounted tile panel 10, together with an outer mounting strip 20 with screws 50 through its mounting surface 21 and panel overlay edge 23 overlaying the edge 13 of panel 10, while the other edge 13 of panel 10 underlays a panel overlay edge 33 of inner mounting strip 30. Four screws 50 are employed to attach the entire tile hanging device 1 to a substrate (not pictured).

Figure 3:
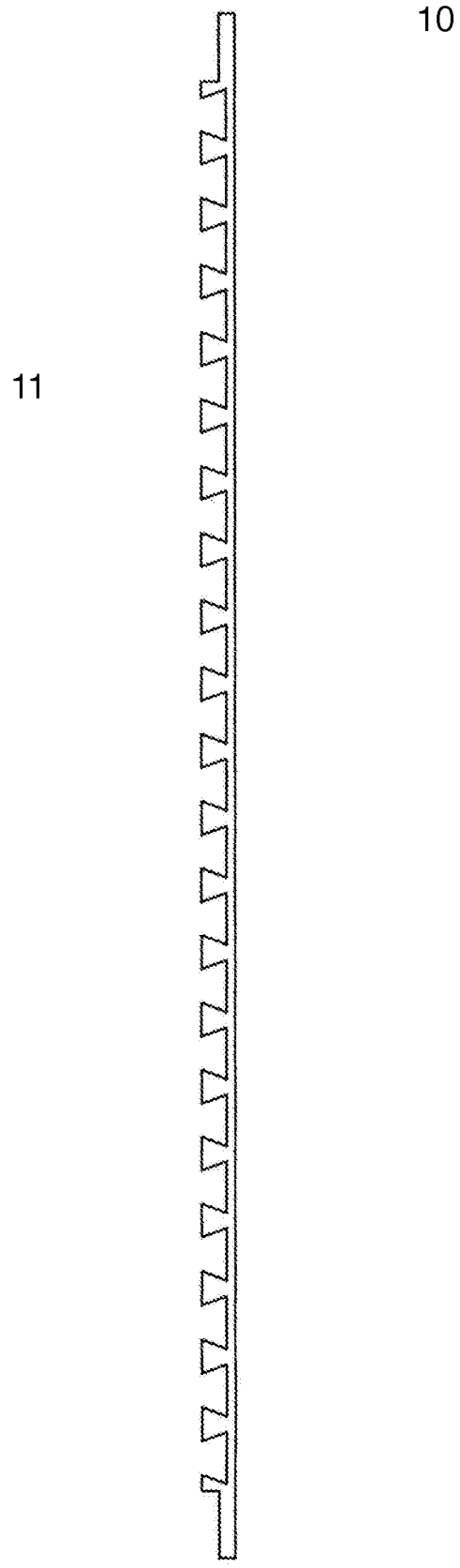
FIG. 3 is a line drawing evidencing a tile panel.

FIG. 3 is a side view of tile panel 10 evidencing the panel grooves 11.

LIST OF REFERENCE NUMBERS

1 tile hanging device
10 tile panel
11 panel grooves
12 panel edge
13 panel slots
20 outer mounting strip
21 mounting surface
22 screw holes
23 panel holding edge
30 inner mounting strip
31 mounting surface
32 screw holes
33 panel holding edge
40 corner mounting strip
41 mounting surface
42 screw holes
43 holding edge
50 drywall screw
60 tile adhesive
70 tile
80 grout The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A tile installation device consisting of:

at least two tile panels having tiles adhered thereto with a tile adhesive, a first of the at least two tile panels being a top tile panel and a second of the at least two tile panels being a bottom tile panel, two discrete outer mounting strips, wherein a first of the two discrete outer mounting strips is positioned on a top edge of the top tile panel and a second of the two discrete outer mounting strips is positioned on a bottom edge of the bottom tile panel, each discrete outer mounting strip having a mounting surface that is directly attached to an underlying wall substrate with fasteners and a panel holding edge that overlays a respective tile panel edge and holds the respective tile panel edge against the underlying wall substrate, and a discrete inner mounting strip positioned at a meeting point between the top and bottom tile panels, the discrete inner mounting strip having a central mounting surface located between two respective panel holding edges, each respective panel holding edge overlaying a different said tile panel.

2. The tile installation device of claim 1, wherein the fasteners are screws.

3. The tile installation device of claim 1, wherein each of the panels and each mounting strip are made of recycled plastic.

4. The tile installation device of claim 3, wherein each of the panels and each mounting strip is made of polyethylene terephthalate, high density polyethylene or polyvinyl chloride.

5. A tile installation method comprising the steps of:

providing the device of claim 1, attaching the first outer mounting strip to a vertical substrate with the panel holding edge facing upward, placing a respective said tile panel against the underlying wall substrate with a lower edge of the tile panel under such panel holding edge, attaching the second outer mounting strip with the panel holding edge facing downward to the underlying wall substrate with such downward-facing panel holding edge overlaying the top edge of the respective tile panel, applying tile adhesive over the respective tile pane, and placing tiles into the adhesive and applying grout between the tiles.

6. The method of claim 5, wherein the tile panel is subsequently removed and replaced with a replacement panel and such replacement panel either ready for tiling or has already been tiled.

* * * * *